US006170661B1

(12) United States Patent
Royal

(10) Patent No.: US 6,170,661 B1
(45) Date of Patent: Jan. 9, 2001

(54) PROTECTIVE DEVICE FOR DECORATIVE BOWS ON GIFT-WRAPPED PACKAGES

(76) Inventor: Mary Anne Royal, 141 Lebanon Rd., Winterport, ME (US) 04496

( * ) Notice: Under 35 U.S.C. 154(b), the term of this patent shall be extended for 0 days.

(21) Appl. No.: 09/420,878

(22) Filed: Oct. 19, 1999

(51) Int. Cl.[7] ..... B65D 73/00
(52) U.S. Cl. ..... 206/457; 220/601; 428/7
(58) Field of Search ..... 206/457, 216, 206/423; 150/154; 229/923, 87.19; 428/7, 11, 17; 220/601; 119/855

(56) References Cited

U.S. PATENT DOCUMENTS

| | | | | |
|---|---|---|---|---|
| 3,767,104 | * | 10/1973 | Bachman et al. | 206/423 |
| 5,054,235 | * | 10/1991 | Pilz | 206/423 |
| 5,292,003 | * | 3/1994 | Baghdassarian | 206/457 |
| 5,315,785 | * | 5/1994 | Avot et al. | 206/423 |
| 5,595,298 | * | 1/1997 | Straeter | 206/423 |

* cited by examiner

*Primary Examiner*—Paul T. Sewell
*Assistant Examiner*—Shian Luong
(74) *Attorney, Agent, or Firm*—Thomas L. Bohan; G. Mathew McCloskey

(57) ABSTRACT

A device for protecting bows on gift-wrapped packages and the like. The device consists of two main components: a cup and a shield. The cup is of a type otherwise useful for drinking or eating ice cream from that has had its bottom portion cut into a number of pie-shaped segments all pointing to the center. The pie segments are flexible so that one can push the cup, bottom-first, over the bow to be protected, without harming the bow. Similarly, when the bow is to be displayed, the cup can be pulled back over the bow gently. The shield component extends across the otherwise open top of the cup, so as to provide protection against rain and other assaults on the bow from above. Operating together, the cup and the shield, when the device is slipped down over a decorative bow can protect the bow from becoming soiled or crushed, with special application to providing such protection when the package bearing the bow is wrapped for transportation, either across town or from one city to another. When the package is subsequently ready for display, the device can be readily removed from the bow and discarded or saved for another occasion.

15 Claims, 1 Drawing Sheet

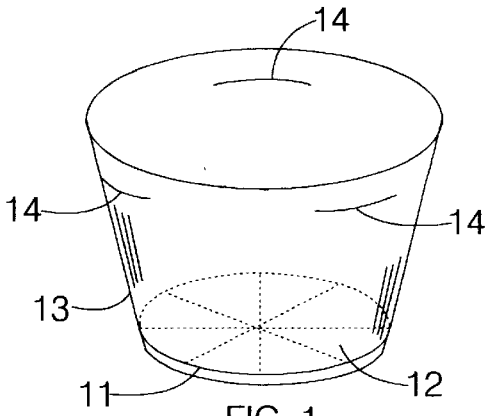
FIG. 1
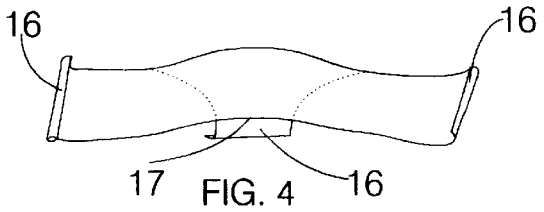
FIG. 4
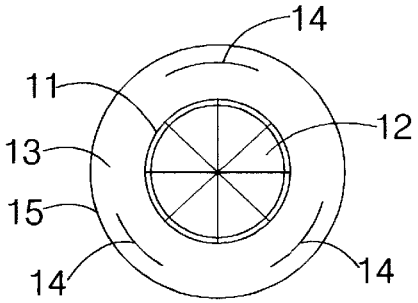
FIG. 2
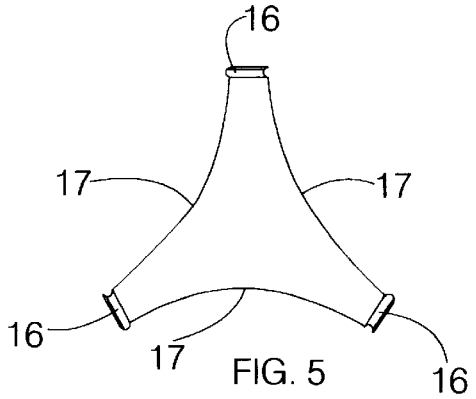
FIG. 5
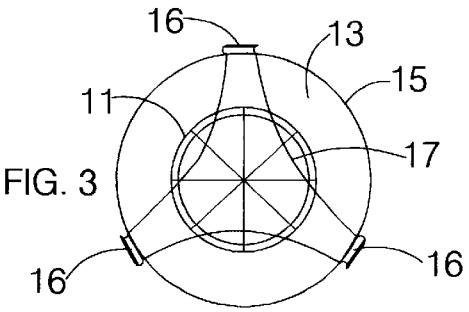
FIG. 3
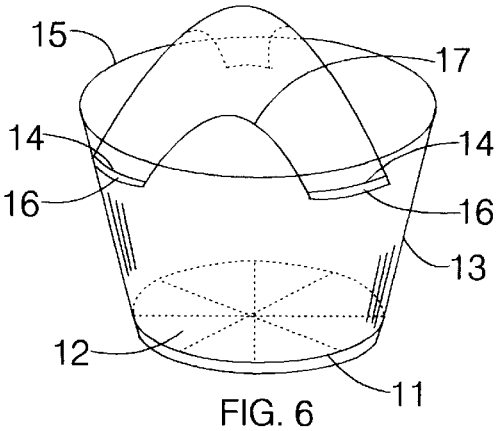
FIG. 6
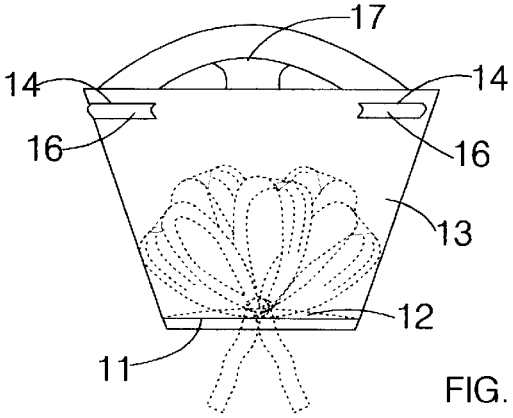
FIG. 7
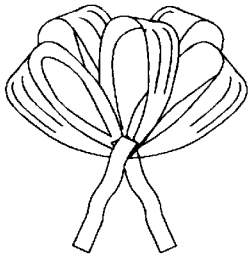

PROTECTIVE DEVICE FOR DECORATIVE BOWS ON GIFT-WRAPPED PACKAGES

CROSS-REFERENCE TO RELATED INVENTIONS

Not Applicable

STATEMENT REGARDING FEDERALLY SPONSORED RESEARCH OR DEVELOPMENT

Not Applicable

BACKGROUND OF THE INVENTION

To my knowledge after extensive research there arc no related inventions. No prior art that describes a method for protecting decorative bows affixed to gift packages, i.e. baskets, bags, boxes, was found. The problem of packaging and/or transporting gifts with decorative bows without damage to the bow, either in the form of crushing, crumpling or flattening does not appear to have a prior solution.

BRIEF SUMMARY OF THE INVENTION

The invention described herein is a collar and shield for decorative bows that are affixed to gift packages, i.e. baskets, bags, boxes. Collar and shield are manufactured from waxed or laminated paper. The collar is cup-shaped. The shield is circular in shape and is inserted into the top of the collar after the bow has been placed in the collar. The collar and shield are designed to be flexible enough to accommodate the stress encountered in transporting gift packages under normal conditions. The collar and shield will prevent crushing, crumpling or flattening of the decorative bows. Accordingly, several objects and advantages of my invention are 1) bows of various sizes, either before or after attachment to the gift package, can be placed inside the protective collar, 2) under normal packaging or transport conditions the protective collar and shield will prevent crushing, flattening and/or crumpling of the bow, 3) the shield prevents other packaging material, such as Styrofoam peanuts, from entering the collar, 4) the collar serves to refresh the bow when it is removed, and 5) the collar and shield are constructed to allow for multiple re-use.

BRIEF DESCRIPTION OF THE DRAWINGS

FIG. 1 is a perspective side view of the collar of the Preferred Embodiment of the present invention.

FIG. 2 is an orthogonal view of the bottom of the collar shown in FIG. 1.

FIG. 3 is an orthogonal top view of the Preferred Embodiment of the present invention with the shield in place.

FIG. 4 shows a side view of the shield by itself, illustrating its rolled tabs.

FIG. 5 is a top view of the shield by itself.

FIG. 6 is a side view of the completed device that constitutes the Preferred Embodiment of the present invention.

FIG. 7 shows the Preferred Embodiment device having been placed over a decorative bow, the enclosed bow being depicted by dashed lines, and also by a similar bow to the side of the figure.

DETAILED DESCRIPTION OF THE INVENTION

This invention is a protective collar and shield for decorative bows affixed to gift packages, i.e. baskets, bags, boxes.

A collar FIG. 1 is constructed from light to medium-weight paper that has been waxed or laminated and is a cup-shaped form. A collar base 11 of various predetermined circumferences cut into a predetermined number of radial pie-shaped sections 12 allows for entry and exit of the bow and/or its attachment mechanism, as well as serving as a mechanism for keeping a collar attached to the bow once it is affixed to the gift package, i.e. baskets, bags, boxes. A collar side 13 has various predetermined heights, accommodating a wide variety of commercially made or homemade bow sizes and shapes. A set of slits 14 are evenly spaced below and parallel to a rim 15. A rim 15 has various predetermined circumferences.

A shield FIG. 4 is constructed from light to medium-weight paper that has been waxed or laminated. A shield is circular in its basic shape with various predetermined circumferences. A shield shown in FIG. 5 has three concave indentations 17 and three rolled-edge tabs 16 for insertion into collar slits 14. FIG. 3 shows a shield attached to a collar by inserting a rolled tab 16 into a slit 14. A shield is sized to fit the varying circumferences of a collar.

A bow FIG. 7 can be pulled through the radial slits if it is already attached to a gift box/bag/basket, with no damage to the bow; or, a bow can be placed in a collar with the bowls attachment mechanism pulled out through the radial slits and then affixed to a gift package. A shield is attached by pushing the rolled tabs 16 through the collar slits 17. The whole assembly is removed from the gift package by pulling the collar and attached shield off the bow. The radial slits 12 act as fingers pulling and refreshing the bow as it comes out of a collar. The collar and shield can be disassembled and used again.

LIST OF DRAWING REFERENCE NUMERALS

11 base of collar
12 radial pie-shaped sections in base
13 side of collar
14 parallel slits in collar
15 rim of collar
16 rolled tabs of shield
17 concave indentations of shield.

What I claim as my invention is:

1. A device for protecting decorative bows affixed to gift packages, said device comprising a flexible cup-like container having (a) a base bounded by a bottom perimeter, (b) cylindrical side walls, and (c) an open top, said top being bounded by a top rim, said base being cut into a pie-like pattern made up of individual pieces, each of said individual pieces affixed to said bottom perimeter, such that when said device is pushed bottom-first onto a decorative bow, said individual pieces allow passage of said bow into said container without damage to said bow, thus allowing said device to be placed onto and over said bow to protect said bow.

2. A device as described in claim 1 also comprising a fitted cover having a cover top and a cover bottom, wherein said fitted cover is affixed to said container by a cover-affixing means and extends across said open top.

3. A device as described in claim 2 wherein a plurality of partially circumferential slits are placed in said side walls at a fixed distance below said rim, and wherein said fitted cover has rolled end tabs at its outer extremities, said slits being disposed so that rolled end-tabs can be inserted into said slits in said cover-affixing means.

4. A device as described in claim 3 wherein said cover top is convex and said cover bottom is concave and wherein when said fitted cover is affixed to said container, said cover top faces outward from said top of said container.

5. A kit for a bow-protective device, said kit comprising a cup-like container and a fitted cover, said cup-like container having a bottom section that is cut into a pie-like pattern that yields when said cup-like container is placed over a decorative bow allowing passage into said cup-like container by said decorative bow without damage to said decorative bow.

6. A kit as described in claim 5 wherein said cup-like container also includes a cylindrical side-wall and a circular top rim at a top of said side-wall, said side-wall containing a number of partially circumferential slits, said slits being parallel to said top rim, and wherein said fitted cover has a plurality of extremities, each of said extremities being in the form of a rolled tab, wherein said tab is insertable into one of said circumferential slits.

7. The kit as described in claim 6 wherein said fitted cover contains a plurality of concave indentations, said plurality of concave indentations being equal in number to said plurality of slits, and wherein said fitted cover also contains a plurality of rolled-edge tabs equal in number to that of said plurality of slits, said plurality of rolled-edge tabs being adapted to be inserted in said spaced slits of said cup-like container.

8. The kit of claim 7, wherein said cup-like container is made from plastic.

9. The kit of claim 7, wherein said fitted cover is made from plastic.

10. The kit of claim 7, wherein said cup-like container is made from paper.

11. The collar of claim 7, wherein said fitted cover is made from paper.

12. The collar of claim 7, wherein said cup-like container is made from waxed paper.

13. The collar of claim 7, wherein said fitted cover is made from waxed paper.

14. A device for protecting a decorative bow affixed to gift packages, said device comprising a cup-like container produced from waxed paper and a fitted cover, said cover being produced from waxed paper, wherein a base of said container is radially cut to make equal-sized, pie-shaped flexible sections to allow said bow to enter and exit said container, whereby said bow can be transported without being crushed, crumpled, or flattened.

15. The device as described in claim 14 wherein said cover contains a plurality of concave indentions and rolled-edge tabs, wherein said tabs attach said cover to said container, thus protecting said bow from above.

* * * * *